US008597050B2

(12) United States Patent
Flaherty et al.

(10) Patent No.: US 8,597,050 B2
(45) Date of Patent: Dec. 3, 2013

(54) DIGITAL, SMALL SIGNAL AND RF MICROWAVE COAXIAL SUBMINIATURE PUSH-ON DIFFERENTIAL PAIR SYSTEM

(75) Inventors: Thomas E Flaherty, Surprise, AZ (US); Dennis Francis Hart, Phoenix, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 12/966,419

(22) Filed: Dec. 13, 2010

(65) Prior Publication Data

US 2011/0151714 A1 Jun. 23, 2011

Related U.S. Application Data

(60) Provisional application No. 61/288,493, filed on Dec. 21, 2009.

(51) Int. Cl.
*H01R 9/05* (2006.01)

(52) U.S. Cl.
USPC ..... 439/578

(58) Field of Classification Search
USPC ..... 439/578, 581, 580, 589; 385/59
See application file for complete search history.

(56) References Cited

U.S. PATENT DOCUMENTS

| | | | | | |
|---|---|---|---|---|---|
| 4,227,765 | A | * | 10/1980 | Neumann et al. | 439/248 |
| 4,334,730 | A | | 6/1982 | Colwell et al. | 339/130 |
| 4,477,132 | A | | 10/1984 | Moser et al. | 339/14 |
| 4,846,731 | A | * | 7/1989 | Alwine | 439/651 |
| 4,895,521 | A | | 1/1990 | Grabbe | 439/63 |
| 4,925,403 | A | | 5/1990 | Zorzy | 439/578 |
| 5,067,912 | A | * | 11/1991 | Bickford et al. | 439/578 |
| 5,203,717 | A | | 4/1993 | Beck et al. | 439/460 |
| 5,217,391 | A | * | 6/1993 | Fisher, Jr. | 439/578 |
| 5,273,443 | A | | 12/1993 | Frantz et al. | 439/595 |
| 5,295,683 | A | | 3/1994 | Tate | 273/32 |
| 5,490,033 | A | | 2/1996 | Cronin | 361/212 |
| 5,498,175 | A | | 3/1996 | Yeh et al. | 439/578 |
| 5,516,303 | A | * | 5/1996 | Yohn et al. | 439/248 |
| 5,611,707 | A | | 3/1997 | Meynier | 439/353 |
| 5,865,654 | A | | 2/1999 | Shimirak et al. | 439/852 |
| 5,890,926 | A | | 4/1999 | Pauza et al. | 439/445 |
| 5,906,511 | A | | 5/1999 | Bozzer et al. | 439/579 |
| 6,071,127 | A | | 6/2000 | Acke et al. | 439/63 |
| 6,095,841 | A | * | 8/2000 | Felps | 439/312 |
| 6,164,977 | A | | 12/2000 | Lester | 439/63 |
| 6,338,653 | B1 | | 1/2002 | Jones et al. | 439/579 |
| 6,398,593 | B1 | | 6/2002 | Yeh | 439/723 |
| 6,692,262 | B1 | | 2/2004 | Loveless | 439/63 |

(Continued)

FOREIGN PATENT DOCUMENTS

| | | | | |
|---|---|---|---|---|
| DE | 10202637 C1 | 8/2003 | | H01R 13/11 |
| DE | 202008011118 U1 | 12/2008 | | H05K 3/36 |

(Continued)

OTHER PUBLICATIONS

Patent Cooperation Treaty, International Search Report for PCT/US2011/027903, Jun. 29, 2011, pp. 1-2.

*Primary Examiner* — Alexander Gilman

(57) ABSTRACT

The differential pair system includes a push-on high frequency differential connector sleeve and push-on high frequency differential connector. The system allows for blind mating of the two components, using a keying system for the two electrical conductors to be axially and radially aligned.

25 Claims, 14 Drawing Sheets

(56) References Cited

U.S. PATENT DOCUMENTS

| | | | | |
|---|---|---|---|---|
| 6,827,608 | B2 | 12/2004 | Hall et al. | 439/578 |
| 7,309,255 | B2 * | 12/2007 | Rodrigues | 439/578 |
| 7,393,214 | B2 | 7/2008 | DiStefano | 439/66 |
| 7,654,747 | B2 * | 2/2010 | Theuerkorn et al. | 385/59 |
| 7,744,383 | B2 * | 6/2010 | Da Silva | 439/92 |
| 7,972,158 | B2 * | 7/2011 | Wild et al. | 439/257 |
| 8,317,539 | B2 | 11/2012 | Stein | 439/578 |
| 2004/0038586 | A1 | 2/2004 | Hall et al. | 439/578 |
| 2004/0092165 | A1 | 5/2004 | Holland | 439/607 |
| 2004/0157499 | A1 | 8/2004 | Nania et al. | 439/680 |
| 2006/0051998 | A1 | 3/2006 | Chun et al. | 439/182 |
| 2006/0084286 | A1 | 4/2006 | Kooiman | 439/63 |
| 2006/0258209 | A1 * | 11/2006 | Hall | 439/578 |
| 2009/0264003 | A1 | 10/2009 | Hertzler et al. | 439/299 |
| 2011/0039448 | A1 | 2/2011 | Stein | 439/578 |
| 2011/0151714 | A1 | 6/2011 | Flaherty et al. | 439/578 |

FOREIGN PATENT DOCUMENTS

| | | | | |
|---|---|---|---|---|
| DE | 202008011119 | U1 | 12/2008 | H05K 3/36 |
| EP | 0582960 | B1 | 8/1993 | H01R 17/12 |
| EP | 1207592 | A2 | 11/2001 | H01R 13/646 |
| EP | 1434313 | A1 | 6/2003 | H01R 13/631 |
| EP | 2051340 | A1 | 10/2008 | H01R 13/658 |
| WO | WO98/33243 | | 7/1998 | H01R 17/12 |

* cited by examiner

DIGITAL, SMALL SIGNAL AND RF MICROWAVE COAXIAL SUBMINIATURE PUSH-ON DIFFERENTIAL PAIR SYSTEM

CROSS-REFERENCE TO RELATED APPLICATIONS

This application claims the benefit of, and priority to U.S. Provisional Patent Application No. 61/288,493 filed on Dec. 21, 2009 entitled, "Digital, Small Signal and RF Microwave Coaxial Subminiature Push-on Differential Pair System", the content of which is relied upon and incorporated herein by reference in its entirety.

BACKGROUND OF THE INVENTION

Field of the Invention

The present invention relates generally to a digital, small signal and RF microwave frequency coaxial differential pair connector sleeve and connectors that includes a push-on interface.

TECHNICAL BACKGROUND

Within the technical field of digital, small signal and RF microwave frequency coaxial connectors there exists a subset of connector interface designs engageable without the aid of external coupling mechanisms such as split keying dielectric components. These interconnect systems are known in the industry as Twin axial TNC's and BNC's. Twin axial, differential pair interconnects are used to attach coaxial cables or modules to another object, such as a corresponding connector on an appliance or junction having a terminal, or port, adapted to engage the connector.

Typically existing differential pair connectors utilize a coupling system that includes a female with spring fingers and a corresponding male port configured to receive the female connector with the use of a coupling nut that is either slotted or threaded. However, when confronted with two electrical conductors in the system, the use of a coupling nut becomes impractical.

It would be an advantage, therefore, to provided a streamlined, cost competitive push-on, self aligning interconnect locking system integral to the connector that provides for easy installation and removal with the use of tools yet be positively mated during use. It would also be advantageous to provide the interconnect system to reduce the footprint taken up by the much larger interconnects in the market.

SUMMARY OF THE INVENTION

In one aspect, a push-on high frequency differential connector sleeve includes an outer body having an outer surface and an inner surface, the inner surface defining an internal opening between a first end and a second end, and a first opening and a second opening in the outer body between the inner and outer surfaces, the first opening extending from the first end toward a center portion and the second opening extending from the second end toward the center portion of the outer body, a tubular body disposed in the internal opening in the outer body, the tubular body engaging the inner surface of the outer body, a dielectric member disposed in the tubular body, the dielectric member having two openings therein to receive two electrical conductors, and two electrical conductors disposed in the two openings in the dielectric member.

In some embodiments, the tubular body has a first end and a second end, the first end and second end are segmented and biased radially outward to engage and retain a corresponding connector.

In other embodiments, the first and second openings in the outer body generally increase in width to allow for gimbaling of connectors inserted therein.

In some embodiments, the two openings in the dielectric member and the openings in the outer body lie on a single plane.

In yet another aspect, a push-on high frequency differential connector includes an outer body having an outer surface, an inner surface, a front end, and a back end, the inner surface defining an opening extending between the front end and the back end, a dielectric member inserted into the opening at the back end of the outer body, the dielectric member having two openings therein, two electrical contacts disposed in the openings in the dielectric member, the electrical contacts extending from the back end towards the front end and beyond a front end of dielectric member, the electric contacts extending radially outward from the opening beyond the outer surface, a dielectric spacer engaging the two electrical contacts beyond the outer surface of the outer body, and an alignment member extending radially upward from the outer surface of the outer body to engage a corresponding opening on a connector sleeve to align the electrical contacts with the connector sleeve.

In still yet another aspect, a push-on high frequency differential pair system that includes a push-on high frequency differential connector sleeve, the connector sleeve further includes a outer body having an outer surface and an inner surface, the inner surface defining an internal opening between a first end and a second end, and a first opening and a second opening in the outer body between the inner and outer surfaces, the first opening extending from the first end toward a center portion and the second opening extending from the second end toward the center portion of the outer body, a tubular body disposed in the internal opening in the outer body, the tubular body engaging the inner surface of the outer body, a dielectric member disposed in the tubular body, the dielectric member having two openings therein to receive two electrical conductors, and two electrical conductors disposed in the two openings in the dielectric member, and a push-on high frequency differential connector, the connector further includes an outer body having an outer surface, an inner surface, a front end, and a back end, the inner surface defining an opening extending between the front end and the back end, a dielectric member inserted into the opening at the back end of the outer body, the dielectric member having two openings therein, two electrical contacts disposed in the openings in the dielectric member, the electrical contacts extending from the back end towards the front end and beyond a front end of dielectric member, the electric contacts extending radially outward from the opening beyond the outer surface, a dielectric spacer engaging the two electrical contacts beyond the outer surface of the outer body, and an alignment member extending radially upward from the outer surface of the outer body to engage a corresponding opening on a connector sleeve to align the electrical contacts with the connector sleeve.

Accordingly, a simple connector is disclosed herein that can easily be produced from a small number of components. The connector preferably forms a reliable electrical RF microwave connection with low mechanical engage and disengage forces. Furthermore, the connector disclosed herein provides an improved electrical performance up to 40 GHz.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
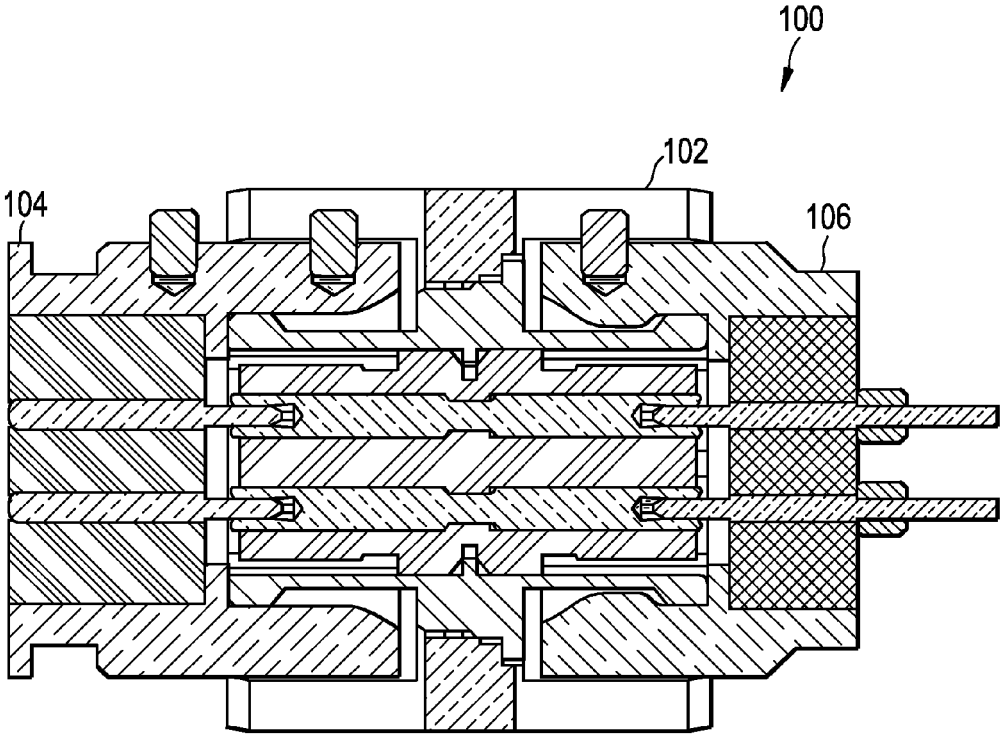
FIG. 1 is a cross sectional view of one embodiment of a connector sleeve and connectors according to the present invention.
Figure 2:
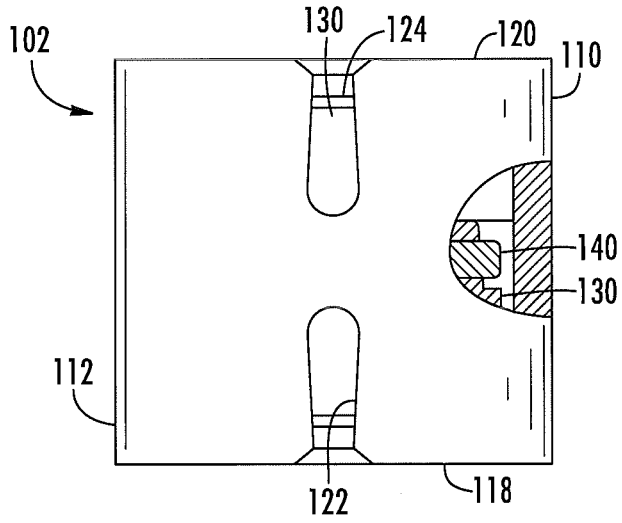
FIG. 2 is a top view of the connector sleeve of FIG. 1.
Figure 3:
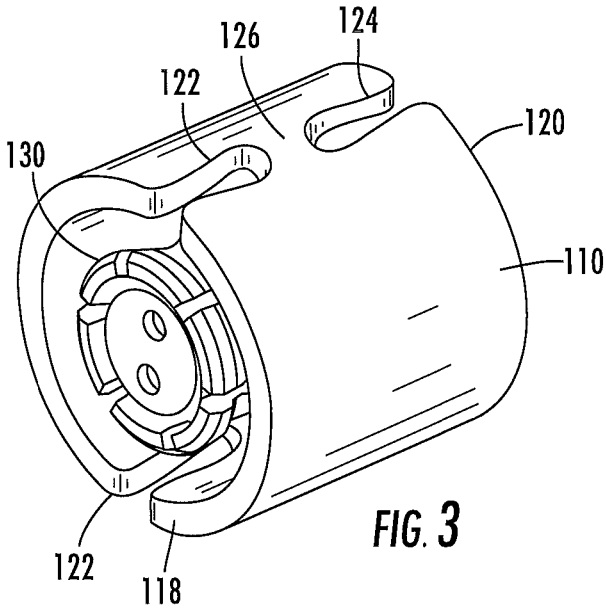
FIG. 3 is a perspective view of the connector sleeve of FIG. 1.
Figure 4:
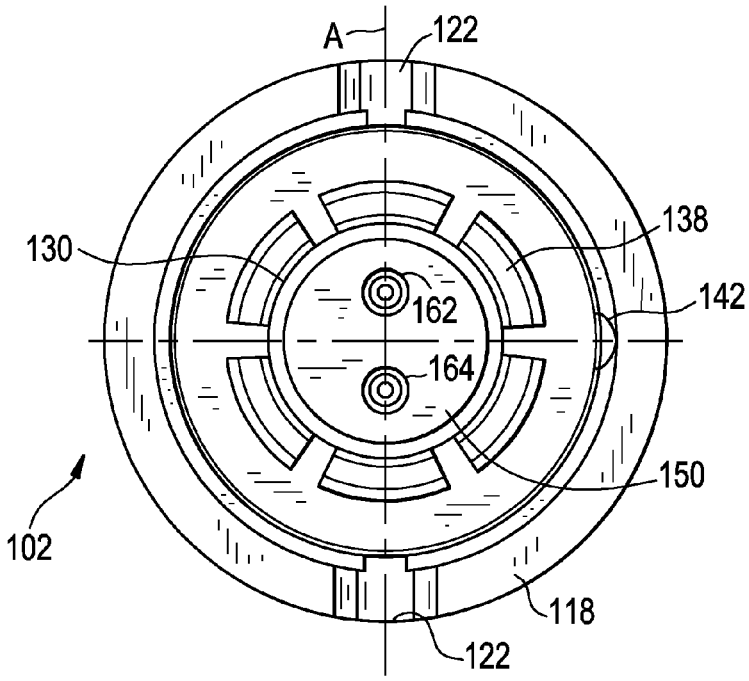
FIG. 4 is a front view of the connector sleeve of FIG. 1.
Figure 5:
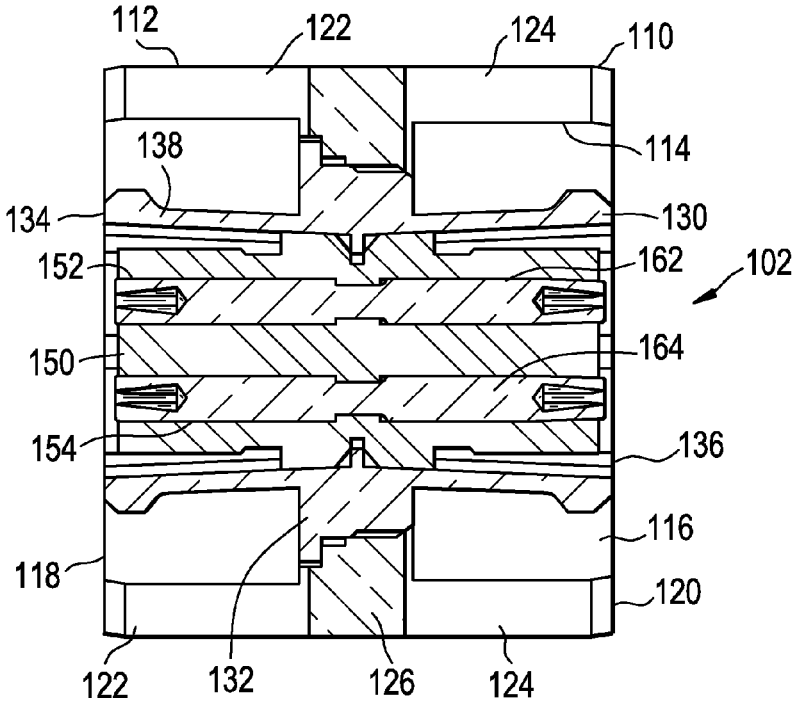
FIG. 5 is a cross-sectional view of the connector sleeve of FIG. 1.
Figure 6:
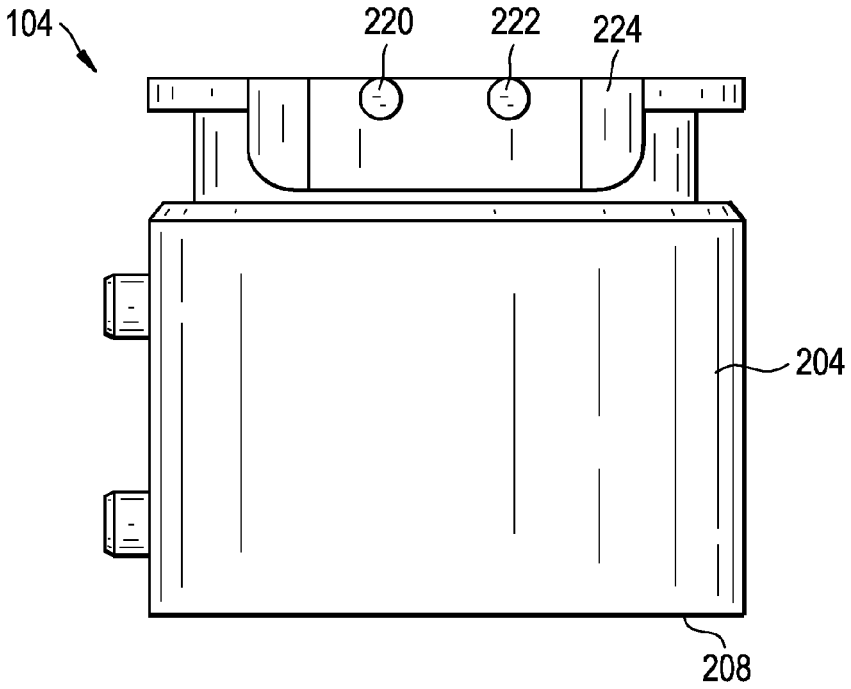
FIG. 6 is a top view of one of the connectors of FIG. 1.
Figure 7:
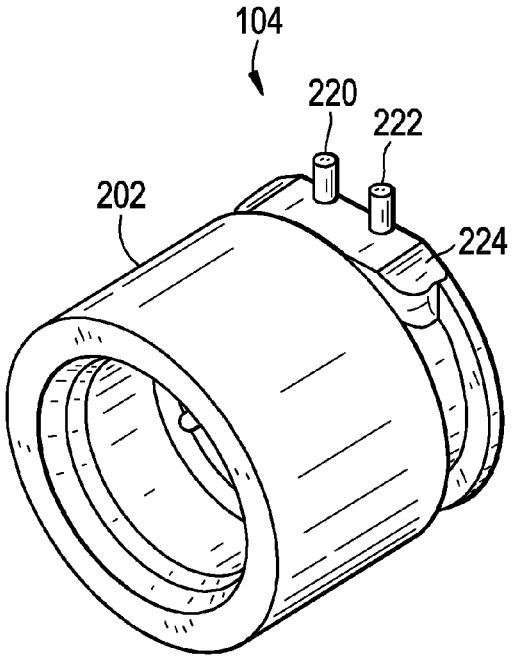
FIG. 7 is a perspective view of the connector of FIG. 6.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIGS. 1-12, a connector assembly 100 includes a connector sleeve 102, a first connector 104, and a second connector 106. Generally, the connector assembly 100 allows for the connection, and in particular, the blind mating of the first connector 104 and the second connector 106. As can be seen from the figures, as well as being described above, the connector assembly 100 provides for a quick way to engage and disengage differential pair interconnects that use push-on technology.

Turning now to FIGS. 2-5, the connector sleeve 102, which is a push-on high frequency differential connector sleeve, includes an outer body 110, an outer surface 112, and inner surface 114, the inner surface 114 defining an internal opening 116 that extends between the first end 118 and the second end 120. The outer body 110 has two sets of openings 122, 124 between the outer surface 112 and the inner surface 114. The openings 122,124 extend from the first end 118 and the second end 120, respectively, towards the middle 126 of the outer body 110. As described in detail below, the openings 122, 124 aid in aligning the first connector 104 and the second connector 106, respectively, with the connector sleeve 102. The connector sleeve 102 has an annular projection 126 extending from the inner surface 114 into the internal opening 116 to engage other portions of the connector sleeve 102 as described in detail below. The connector sleeve 102 is preferably made from metallic material, for example, beryllium copper, and is preferably plated with a corrosion-resistant, conductive material such as gold.

The connector sleeve 102 also includes a tubular body 130 that is disposed in the internal opening 116. An outer portion 132 of the tubular body 130 engages the annular projection 126, typically by being press-fit into the connector sleeve 102. The tubular body 130 has at either end 134, 136 segmented portions 138. Segmented portions 138 are typically finger type portions to engage the first connector 104 and the second connector 106. As can be seen in FIG. 1, the segmented portions 138, which are preferably biased radially outward, engaging an inner portion of the connectors 104, 106 to maintain physical and electrical engagement of the connectors 104,106 with the connector sleeve 102. While six segmented portions 138 are illustrated, any number of segmented portions 138 may be present and still fall within the scope of the present invention. The tubular body 130 is preferably made from a metallic material, for example, beryllium copper, and is plated with a corrosion-resistant, conductive material such as gold.

Also included in the connector sleeve 102 is a dielectric member 150 that is in a center portion of the tubular body 130. The dielectric member 150 has two openings 152,154 to receive two electrical conductors 162, 164. As illustrated best in FIG. 5, the two electrical conductors 162,164 have a female configuration. As discussed below, however, the electrical conductors 162, 164 may also have a male configuration. The tubular body 130 preferably has a projection 140 (see FIG. 2) that engages a corresponding depression 142 (FIG. 4) in the inner surface of the connector sleeve 102. The cooperation of the projection 140 and the corresponding depression 142 helps to align the openings 152,154 with the openings 122, 124 in the connector sleeve 102. In this regard, the two openings 152,154 of the dielectric member 150 lie in the same plane A as the openings 122,124. This allows for the blind mating of the connectors 104,106 with the connector sleeve 102.

Turning now to FIGS. 6-9, the first connector 104 will be discussed in detail. First connector 104 has an outer body 202, the outer body 202 having an outer surface 204 and inner surface 206. The outer body 202 has a front end 208 and a back end 210 and is generally cylindrical in its configuration. The inner surface 206 defines an opening 212 extending between the front end 208 and the back end 210. The opening 212 is divided into a front portion 212*a* and a rear portion 212*b*, the rear portion 212*b* having a dielectric member 214 inserted therein.

Figure 8:
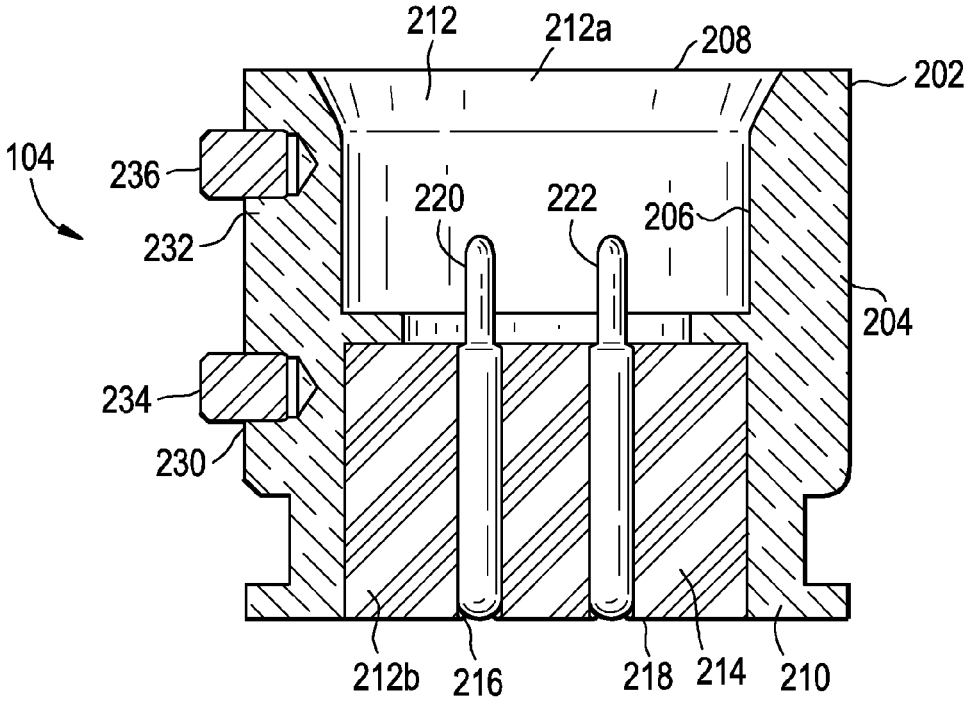
FIG. 8 is a cross-sectional view of the connector of FIG. 6.
Figure 9:
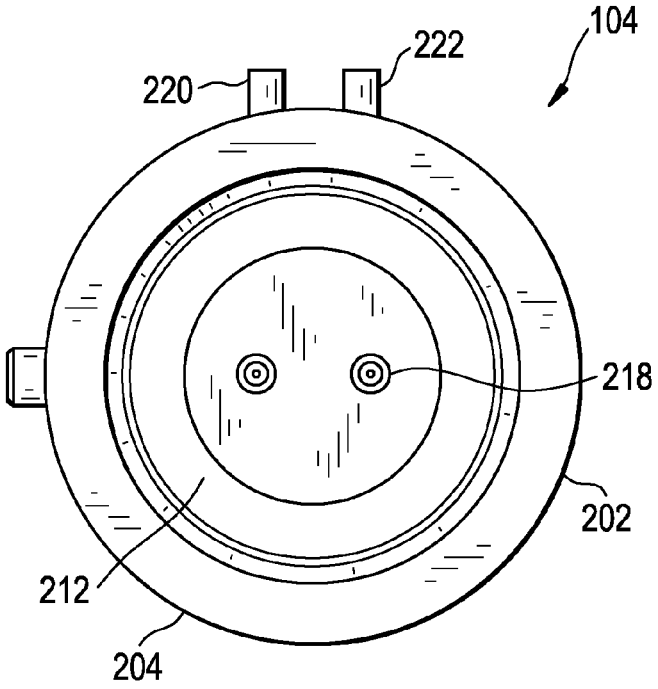
FIG. 9 is a front view of the connector of FIG. 6.

The dielectric member 214 has two openings 216,218 to receive two electrical contacts 220, 222. As best illustrated in FIG. 8, the electrical contacts 220, 222 extend from the back end 210 through the dielectric member 214 and into the front portion 212*a* of the opening 212. The two electrical contacts 220, 222 make a turn at the back end 210 of about 90° and project beyond the outer surface 204 of the outer body 202. See FIGS. 6 and 7. A dielectric spacer 224 surrounds the electrical contacts 220, 222 beyond the outer surface 204 of the outer body 202 to insulate the electrical contacts 220,222 from the outer body 202.

The outer body 202 of the first connector 104 has two holes 230, 232, into which alignment members 234,236, respectively, are inserted. The alignment members 234, 236 are configured to engage and slide into the opening 122 of the connector sleeve 102 as the first connector 104 is inserted into the connector sleeve 102. Thus, the alignment members 234, 236 provide a key for inserting the first connector 104 into the connector sleeve 102 in a correct orientation and eliminate the possibility of stubbing the electrical contacts 220, 222 on the connector sleeve 102. Additionally, the alignment members 234,236 allow for axial and rotational alignment of the electrical conductors 220, 222 with the electrical conductors 162, 164 in the connector sleeve 102. It should also be noted that the openings 122, 124 are preferably wider toward the center portion 126 than they are at the first end 118 and the second end 120. The increasingly wider openings 122, 124 allow the connectors 104,106 the necessary freedom to gimbal as needed when connected to the connector sleeve 102.

Figure 12:
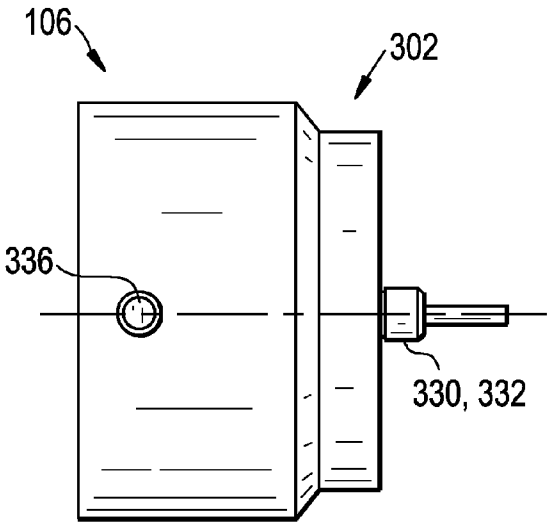
FIG. 12 is a top view of the connector of FIG. 10.
Figure 11:
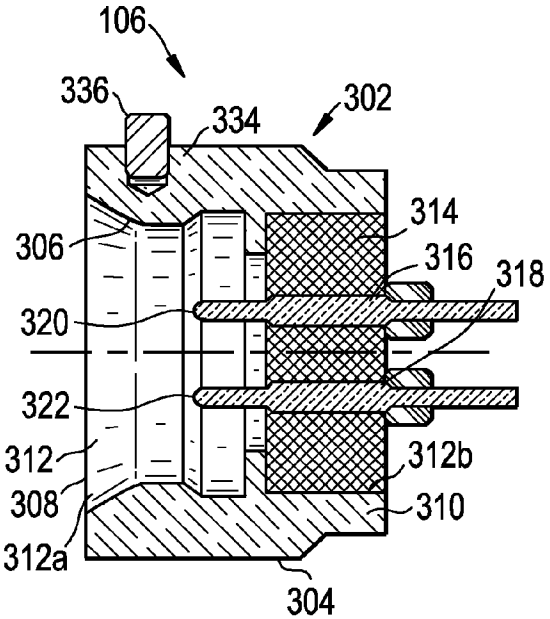
FIG. 11 is a cross-sectional view of the connector of FIG. 10.
Figure 10:
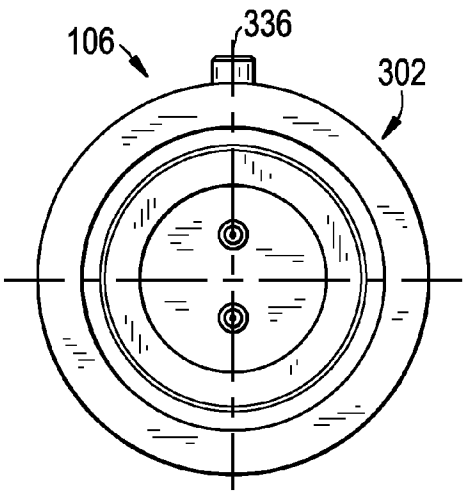
FIG. 10 is a front view of the other of the connectors of FIG. 1.

The second connector 106 will now be described in conjunction with FIGS. 10-12. The second connector 106 has an outer body 302 with an outer surface 304 and an inner surface 306. The second connector 106 has a front end 308, a back end 310 and is generally cylindrical in configuration. The inner surface 306 defines an opening 312 extending between the front end 308 and the back end 310. The opening 312 is divided into a front portion 312*a* and a rear portion 312*b*, the rear portion 312*b* having a dielectric member 314 inserted therein. The dielectric member 314 has two openings 316, 318 to receive two electrical contacts 320,322. The electrical contacts 320,322 extend beyond the back end 310 and into the front portion 312*a*. Electrical contacts 320,322 also have insulators 330,332 to further insulate the electrical contacts 320,322 and to also provide an alignment mechanism for insertion of the second connector 106 into a blind panel (not shown).

The outer surface 304 has a hole 334 into which an alignment pin 336 has been inserted to provide alignment with the opening 124 in the connector sleeve 102. As with the first connector 104, the alignment pin 336 functions as a key to ensure the correct positioning of the second connector 106 so that the electrical contacts in the second connector 106 and the connector sleeve 102 are appropriately aligned. The segmented portions 138 engage the inner surface 306 when the connector 106 is installed into the connector sleeve 102.

Figure 13:
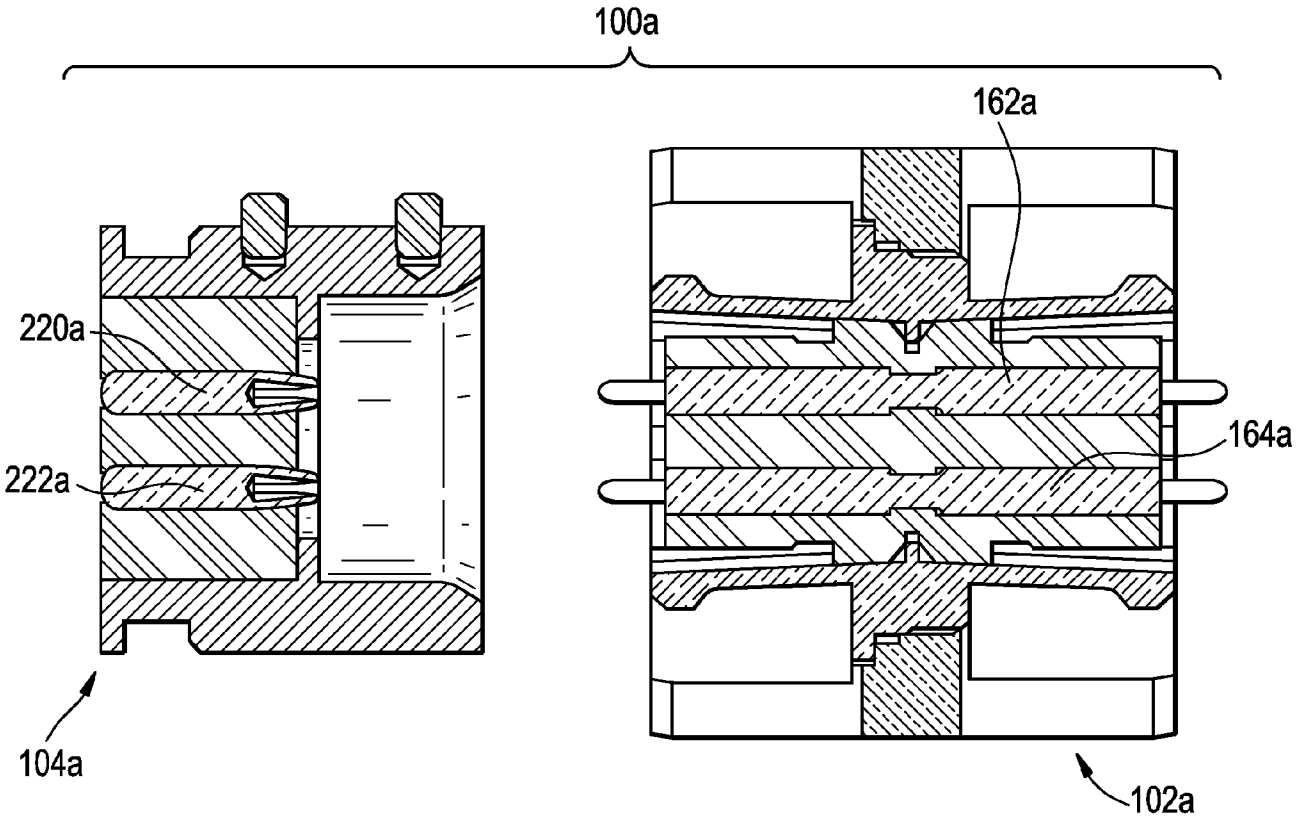
FIG. 13 is an exploded, cross-sectional view of an alternative embodiment of a connector and connector sleeve according to the present invention.

An alternative embodiment of a connector assembly 100*a* according to the present invention is illustrated in FIG. 13. A first connector 104*a* and a connector sleeve 102*a* make up the connector assembly 100*a*. However, a second connector can also be modified as noted below to be included in the connector assembly 100*a*. Connector assembly 100*a* is similar to connector assembly 100 as described above, but the configuration of the electrical conductors have been reversed. That is, the electrical conductors 162*a*,164*a* in connector sleeve 102*a* have a male configuration, while the electrical conductors 220*a*,222*a* have a female configuration.

Figure 14:
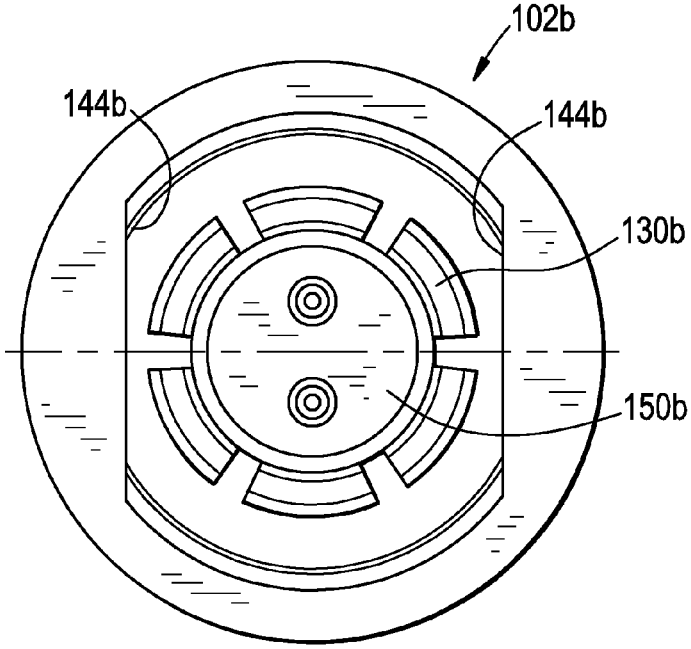
FIG. 14 is a front view of the alternative embodiment of a connector sleeve according to the present invention.
Figure 15:
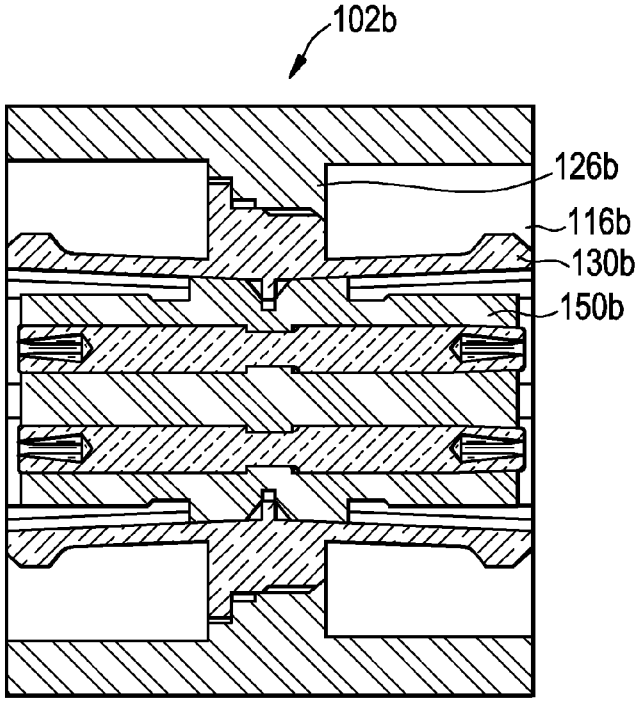
FIG. 15 is a cross-sectional view of the connector sleeve of FIG. 14.

An alternative configuration for the connector sleeve 102*b* is illustrated in FIGS. 14-15. The internal configuration of connector sleeve 102*b* is illustrated as being the same as connector sleeve 102. That is, connector sleeve 102*b* has an annular projection 126*b* extending from the inner surface 114*b* into the internal opening 116*b* to engage other portions of the connector sleeve 102*b*. The connector sleeve 102*b* also includes a tubular body 130*b* that is disposed in the internal opening 116*b* and a dielectric member 150*b*. However, the internal opening 116*b* has two flat portions 144*b* [FIG. 14 needs a b after 144] to orient a corresponding connector with regard to the connector sleeve 102*b*. As can be seen in the figures, the openings 122,124 are not present in the outer body 110 since the internal flat portions 144*b* act as the key for the corresponding connector, making the openings 122,124 unnecessary.

Figure 18:
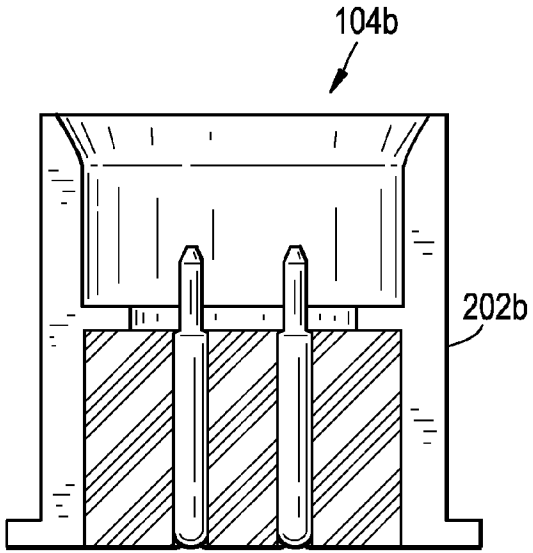
FIG. 18 is a cross-sectional view of the connector of FIG. 16.
Figure 17:
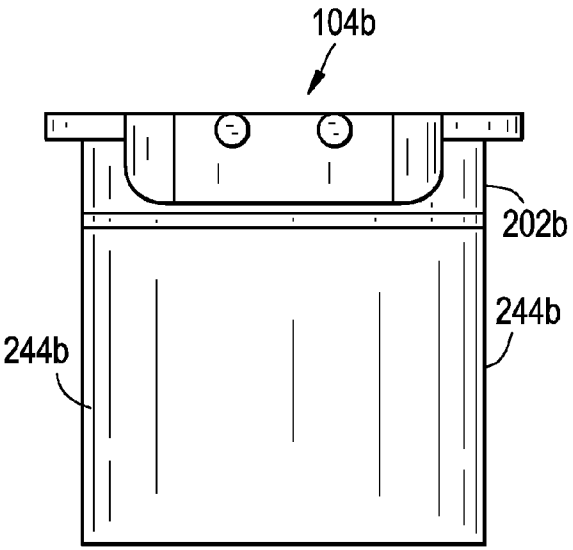
FIG. 17 is a top view of the connector of FIG. 16.
Figure 16:
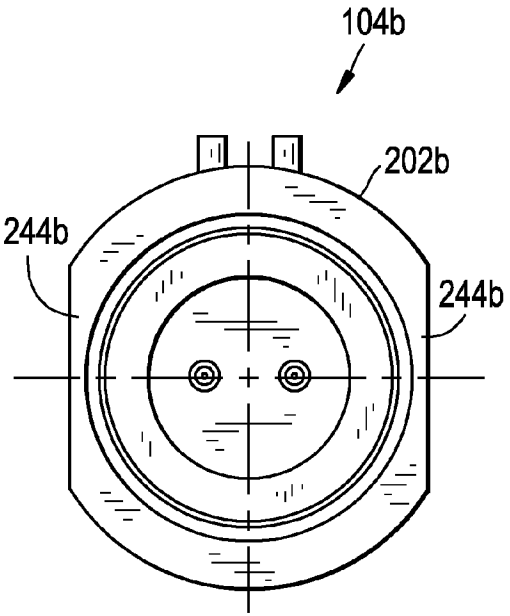
FIG. 16 is a front view of an alternative embodiment of a connector according to the present invention.

Further in this regard, a corresponding first connector 104*b* is illustrated in FIGS. 16-18. The connector 104*b* is similar to the connector 104 discussed above, but rather being substantially circular in cross section (see FIG. 9), connector 104*b* has two corresponding flat portions 244*b* in the outer body 202*b*. The flat portions 244*b* correspond to and align the connector 104*b* with flat portions 144*b* of the connector sleeve 102*b*. As a result, the connector 104*b* does not need the alignment members of connector 104.

Figure 21:
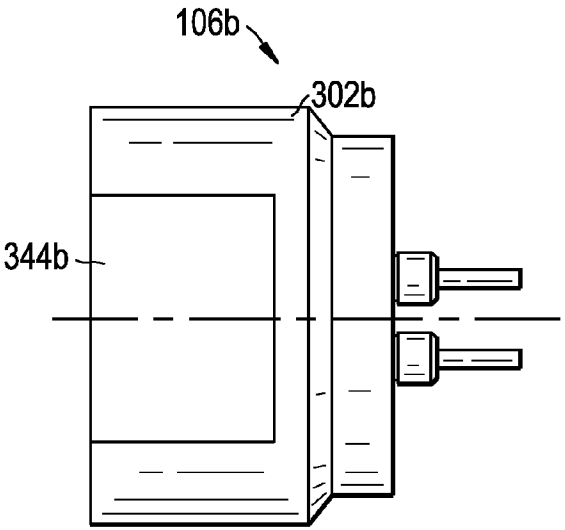
FIG. 21 is a side view of the second connector of FIG. 19.
Figure 20:
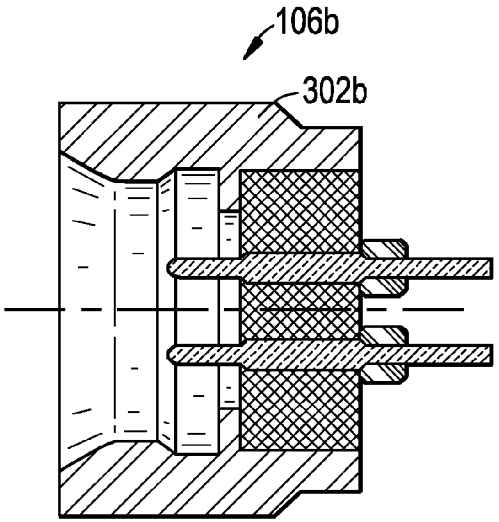
FIG. 20 is a cross-sectional view of the second connector of FIG. 19.
Figure 19:
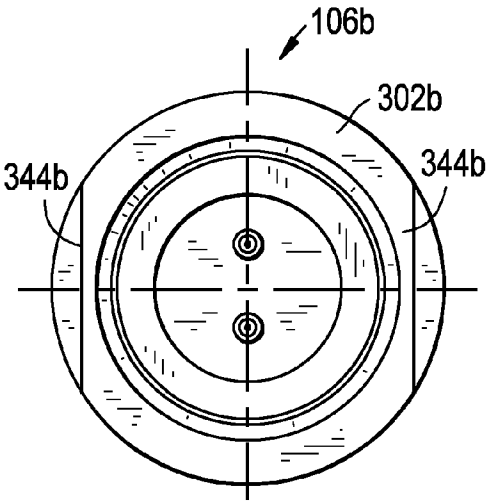
FIG. 19 is a front view of an alternative embodiment of a second connector to be used with the connector sleeve of FIG. 14.

Similarly, a second connector 106*b*, illustrated in FIGS. 19-21 and an alternative embodiment of second connector 106, also has two flat portions 344*b*, which align the second connector 106*b* with the sleeve 102*b*. The other elements of second connector 106*b* are identical with those of second connector 106, but the outer body 302*b* has the two flat portions 344*b* that extend along only a portion of the outer body 302*b*.

Figure 22:
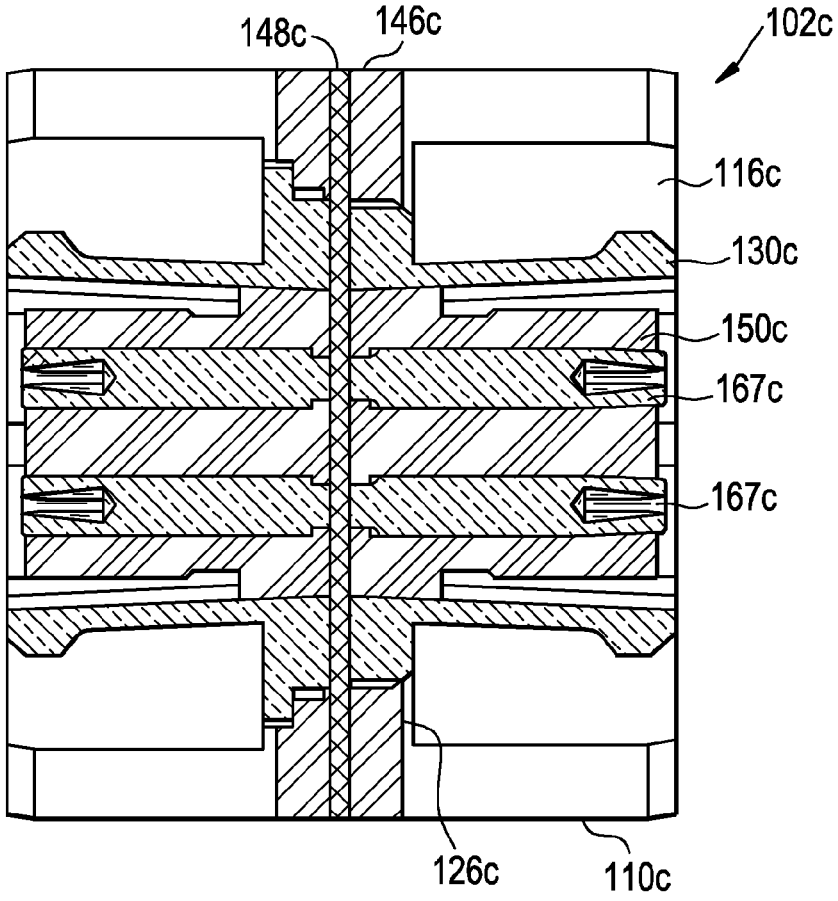
FIG. 22 is a cross-sectional view of another alternative embodiment of a connector sleeve according to the present invention.

FIG. 22 illustrates an alternative embodiment of a connector sleeve 102*c*. The connector sleeve 102*c* has an annular projection 126*c* extending from the inner surface 114*c* into the internal opening 116*c* to engage other portions of the connector sleeve 102*c*. The connector sleeve 102*c* also includes a tubular body 130*c* that is disposed in the internal opening 116*c* and a dielectric member 150*c* with two electrical conductors 160*c*,162*c*. While the electrical conductors 160*c*,162*c* are illustrated as having a female configuration, they may also have a male configuration and alignment. See, e.g., FIG. 13. Connector sleeve 102*c* has a through-hole 146*c* that is filled with an epoxy plug 148*c* to maintain the components of connector sleeve 102*c* in the appropriate configuration. As a result, the projection 140 and depression 142 of connector sleeve 102 are not needed for alignment of the connector sleeve components. The epoxy plug 148*c* is illustrated as penetrating through the electrical conductors 160*c*, 162*c*, but the epoxy plug 148*c* is not electrically conductive, thereby maintaining the electrical integrity of the connector sleeve 102*c*.

Figure 23:
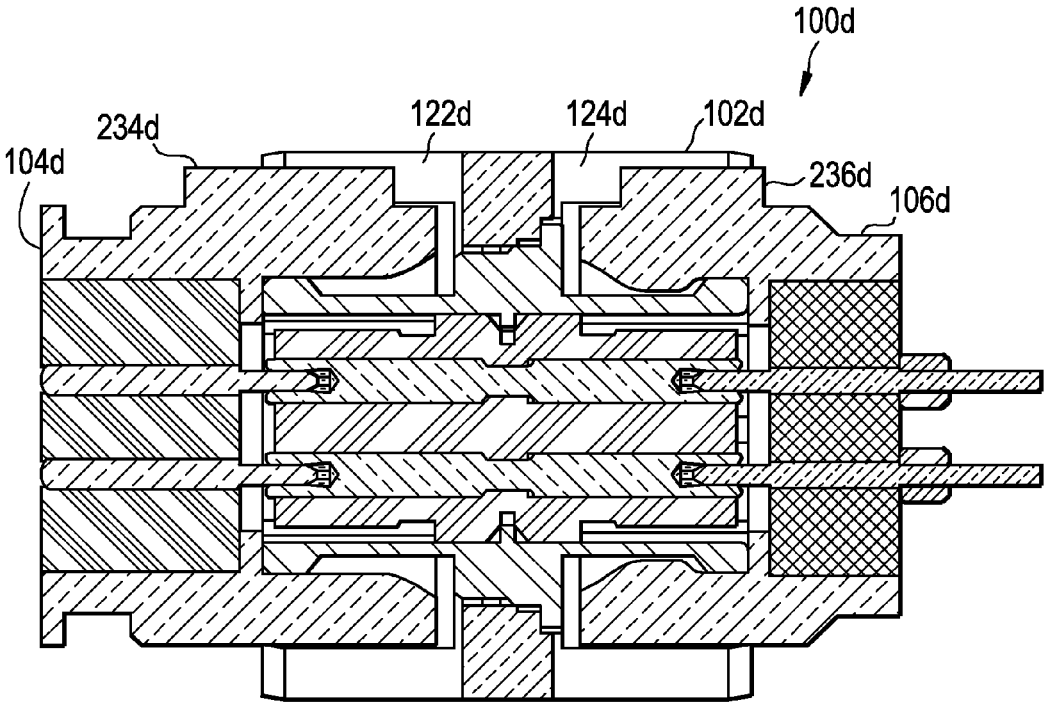
FIG. 23 is a cross-sectional view of an alternative embodiment of a connector sleeve and connectors according to the present invention.

An alternative connector assembly 100*d* is illustrated in FIG. 23 and includes a connector sleeve 102*d*, a first connector 104*d*, and a second connector 106*d*. As illustrated, the first and second connectors 104*d*,106*d* are similar to those discussed above. However, rather than having the holes 230,232, 334 and corresponding alignment members 234,236,336, the connectors 104*d*,106*d* have integral projections 234*d*,236*d*, respectively, to align the connectors 104*d*,106*d* with the openings 122*d*,124*d* in the connector sleeve 102*d*.

Figure 24:
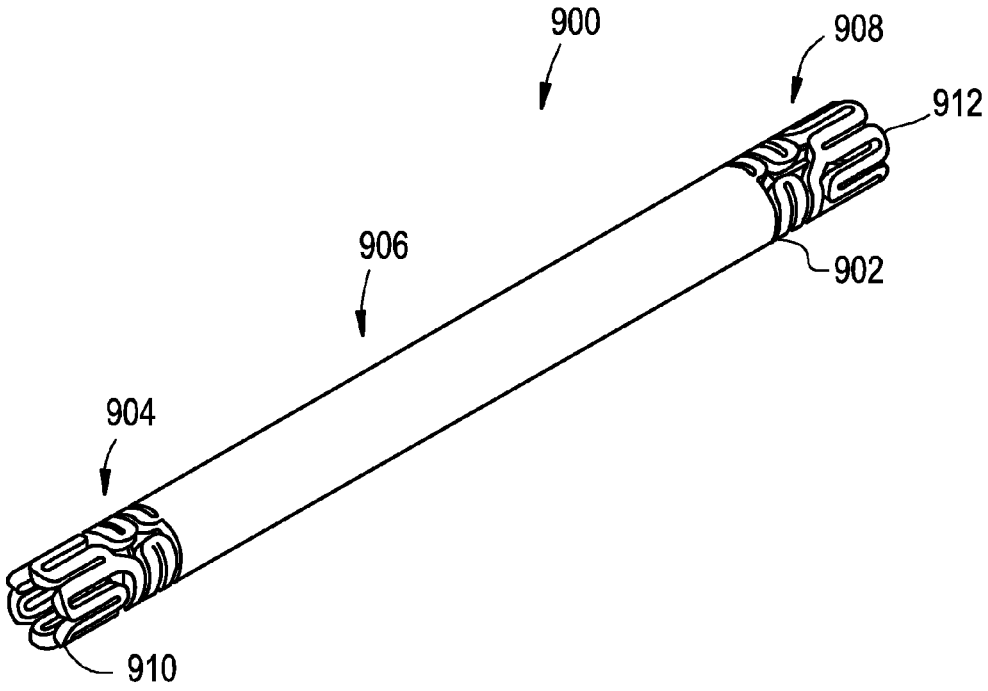
FIG. 24 illustrates an embodiment of a socket contact that can be used as an electrical conductor in an alternate embodiment as disclosed herein.

An alternative socket contact 900 that can be used as an electrical conductor in embodiments disclosed herein is illustrated in FIG. 24, which includes a main body 902 extending along a longitudinal axis. The main body 902 has a proximal portion 904, a distal portion 908, and an elongated central portion 906 that is axially between the proximal portion 904 and the distal portion 908. The main body 902 also has a first end 910 disposed on proximal portion 904 and an opposing second end 912 disposed on distal portion 908. Main body 902 is comprised of electrically conductive and mechanically resilient material having spring-like characteristics that extends circumferentially around the longitudinal axis. Preferred materials for main body 902 include beryllium copper (BeCu), stainless steel, or gold plated nickel. A particularly preferred material for main body 902 is beryllium copper (BeCu).

The material used for main body 902 is patterned to define a plurality of openings and at least a portion of the plurality of openings extend along a longitudinal length of proximal and distal portions 904, 908. However, the elongated central portion 906 constitutes a majority of the length of the main body 902.

Figure 25:
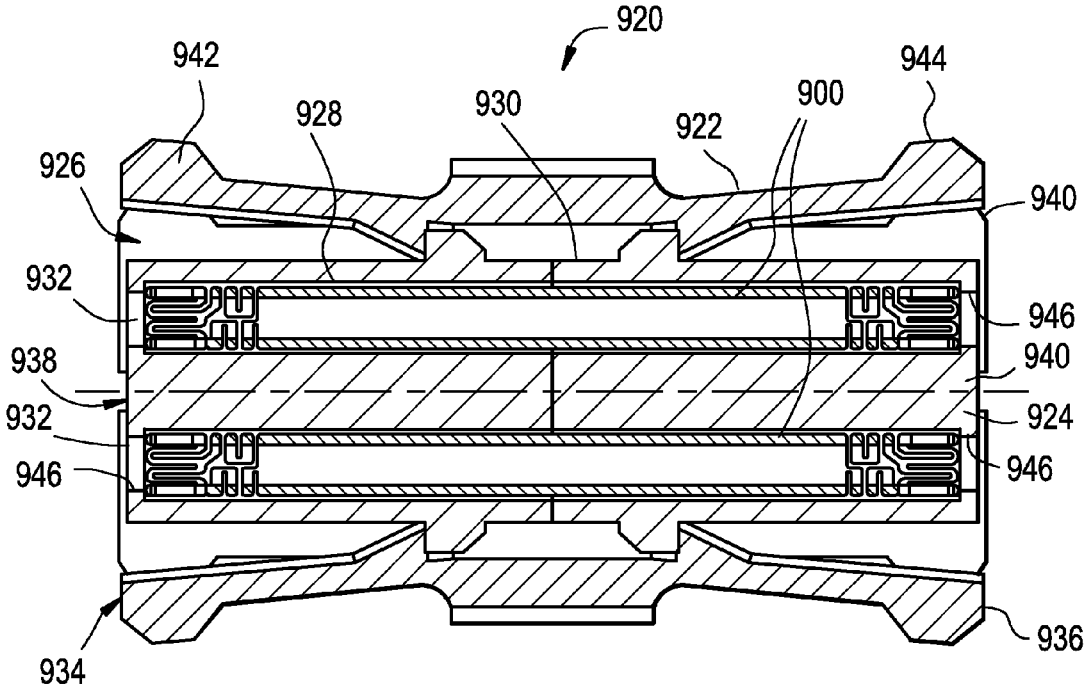
FIG. 25 illustrates another embodiment of a coaxial connector as disclosed herein with the socket contact of FIG. 24.

The alternative socket contact 900 is illustrated in an embodiment of a coaxial connector 920 illustrated in FIG. 25. Coaxial connector 920 includes outer conductor portion 922, insulator 924, and two socket contacts 900 illustrated in FIG. 24. Outer conductor portion 922 extends substantially circumferentially about a longitudinal axis and defines a first central bore 926. Insulator 924 is disposed within the first central bore 926 and extends about the longitudinal axis. Insulator 924 includes first insulator component 928 and second insulator component 930 and defines two openings 932 extending along the length of the insulator 924 (and therefore also along the length of the first and second insulator components 928, 930). A socket contact 900 is disposed within each of the openings 932. Outer conductor portion 922 has a first end 934 and a second end 936. A plurality of first slots 938 extend substantially along a longitudinal direction from the first end 934, and a plurality of second slots 940 extend substantially along a longitudinal direction from the distal end to define a plurality of first cantilevered beams 942 and a plurality of second cantilevered beams 944, wherein the plurality of first cantilevered beams 942 extend substantially circumferentially around first end 934 and the plurality of second cantilevered beams 944 extend substantially circumferentially around second end 936. Two of the cantilevered beams 942, 944 on each side of the outer conductor portion 922 are biased radially outward to provide a keying feature for the differential pair interconnect (not shown). Since there are two openings 932 that are not on a central axis, there must be a method for aligning the contacts in the differential pair interconnect with the openings 932. The two outwardly projecting cantilevered beams 942, 944 on each side match with a corresponding structure on the interconnect to align the contacts with the openings 932.

Openings 932 in the insulator 924 include reduced diameter portions 946 that allow insulator 924 to retain socket contacts 900. In addition, reduced diameter portions 946 provide a lead in feature for mating contacts on the differential pair interconnect.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A push-on high frequency differential connector sleeve comprising:

an outer body having an outer surface and an inner surface, the inner surface defining an internal opening between a first end and a second end, and a first opening and a second opening in the outer body between the inner and outer surfaces, the first opening extending from the first end toward a center portion and the second opening extending from the second end toward the center portion of the outer body;

a tubular body disposed in the internal opening in the outer body, the tubular body engaging the inner surface of the outer body, wherein the tubular body comprises a projection engaging a corresponding depression in the inner surface of the outer body;

a dielectric member disposed in the tubular body, the dielectric member having two openings therein to receive two electrical conductors; and two electrical conductors disposed in the two openings in the dielectric member, wherein the two electrical conductors extend from the first end toward a center portion and the second end toward the center portion allowing for the blind mating of two connectors with the connector sleeve at either end of the sleeve.

2. The push-on high frequency differential connector sleeve according to claim 1, wherein the tubular body has a first end and a second end, the first end and second end are segmented and biased radially outward to engage and retain a corresponding connector.

3. The push-on high frequency differential connector sleeve according to claim 1, wherein the first and second openings in the outer body generally increase in width to allow for gimbaling of connectors inserted therein.

4. The push-on high frequency differential connector sleeve according to claim 1, wherein the two openings in the dielectric member and the first opening and the second opening in the outer body lie on a single plane.

5. The push-on high frequency differential connector sleeve according to claim 1, wherein the inner surface of the outer body is circular in cross section.

6. The push-on high frequency differential connector sleeve according to claim 1, wherein the inner surface of the outer body has at least two flat surfaces, the two flat surfaces on opposites sides of the internal opening.

7. The push-on high frequency differential connector sleeve according to claim 6, wherein the tubular body has a first end and a second end, the first end and second end are segmented and biased radially outward to engage and retain a corresponding connector.

8. The push-on high frequency differential connector sleeve according to claim 6, wherein the inner surface of the outer body is circular in cross section.

9. The push-on high frequency differential connector sleeve according to claim 6, wherein the two conductors, when connected, have a combined 100Ω impedance between the conductors.

10. The push-on high frequency differential connector sleeve according to claim 6, wherein the two conductors have a female configuration.

11. The push-on high frequency differential connector sleeve according to claim 1, wherein the two conductors, when connected, have a combined 100Ω impedance between the conductors.

12. The push-on high frequency differential connector sleeve according to claim 1, wherein the two conductors have a female configuration.

13. A push-on high frequency differential connector comprising:

an outer body having an outer surface, an inner surface, a front end, and a back end providing a mating surface at the front end, the inner surface defining an opening extending between the front end and the back end;

a dielectric member inserted into the opening at the back end of the outer body, the dielectric member having two openings therein;

two electrical contacts disposed in the openings in the dielectric member, the electrical contacts extending from the back end towards the front end and beyond a front end of dielectric member, the electric contacts extending radially outward from the opening beyond the outer surface;

a dielectric spacer engaging the two electrical contacts beyond the outer surface of the outer body, the dielectric spacer including a first end and a second end opposite the first end, the second end of the dielectric spacer is coplanar with the mating surface of the back end of the outer body; and an alignment member extending radially upward from the outer surface of the outer body to engage a corresponding opening on a connector sleeve to align the electrical contacts with the connector sleeve, and wherein the outside surface has at least two flat portions configured to engage a corresponding flat portion in a connector sleeve.

14. The push-on high frequency differential connector according to claim 13, further comprising a channel disposed in the outer body adjacent the back end that forms a lip portion at the back end.

15. The push-on high frequency differential connector according to claim 14, wherein the dielectric spacer is disposed in the channel.

16. The push-on high frequency differential connector according to claim 13, wherein the alignment member comprises two alignment members.

17. The push-on high frequency differential connector according to claim 13, wherein the inner surface at the front end of the outer body has a chamfer to assist in engaging the connector sleeve.

18. The push-on high frequency differential connector according to claim 13, wherein the alignment member and the two electrical contacts in the opening of outer body lie in a single plane.

19. The push-on high frequency differential connector according to claim 13, wherein the electrical contacts turn through an angle of about ninety degrees adjacent the back end of the outer body.

20. The push-on high frequency differential connector according to claim 13, wherein the contacts have a male configuration.

21. The push-on high frequency differential connector according to claim 13, wherein the contacts have a female configuration.

22. The push-on high frequency differential connector according to claim 13, wherein the outside surface is generally circular in cross section.

23. The push-on high frequency differential connector according to claim 13, wherein alignment member is an elongated alignment member.

24. The push-on high frequency differential connector sleeve according to claim 1, wherein the first opening is configured to engage at least one alignment member of a complementary connector received in the first opening, and the second opening is configured to engage a second at least one alignment member of a second complementary connector received in the second opening.

25. A push-on high frequency differential pair system comprising:

a push-on high frequency differential connector sleeve, the connector sleeve further comprising:

an outer body having an outer surface and an inner surface, the inner surface defining an internal opening between a first end and a second end, and a first opening and a second opening in the outer body between the inner and outer surfaces, the first opening extending from the first end toward a center portion and the second opening extending from the second end toward the center portion of the outer body;

a tubular body disposed in the internal opening in the outer body, the tubular body engaging the inner surface of the outer body, wherein the tubular body comprises a projection engaging a corresponding depression in the inner surface of the outer body;

a dielectric member disposed in the tubular body, the dielectric member having two openings therein to receive two electrical conductors; and two electrical conductors disposed in the two openings in the dielectric member; and a push-on high frequency differential connector, the connector further comprising an outer body having an outer surface, an inner surface, a front end, and a back end, the inner surface defining an opening extending between the front end and the back end;

a dielectric member inserted into the opening at the back end of the outer body, the dielectric member having two openings therein;

two electrical contacts disposed in the openings in the dielectric member, the electrical contacts extending from the back end towards the front end and beyond a front end of dielectric member, the electric contacts extending radially outward from the opening beyond the outer surface;

a dielectric spacer engaging the two electrical contacts beyond the outer surface of the outer body; and an alignment member extending radially upward from the outer surface of the outer body to engage a corresponding opening on a connector sleeve to align the electrical contacts with the connector sleeve.

* * * * *